US007528815B2

(12) United States Patent
Shih et al.

(10) Patent No.: US 7,528,815 B2
(45) **Date of Patent: *May 5, 2009**

(54) DRIVING CIRCUIT AND METHOD FOR LIQUID CRYSTAL DISPLAY PANEL

(75) Inventors: Po-Sheng Shih, Tao-Yuan Hsien (TW); Seok-Lyul Lee, Tao-Yuan Hsien (TW)

(73) Assignee: Hannstar Display Corporation, Taipei (TW)

( * ) Notice: Subject to any disclaimer, the term of this patent is extended or adjusted under 35 U.S.C. 154(b) by 695 days.

This patent is subject to a terminal disclaimer.

(21) Appl. No.: 10/755,095

(22) Filed: Jan. 9, 2004

(65) Prior Publication Data

US 2004/0164942 A1 Aug. 26, 2004

(30) Foreign Application Priority Data

Feb. 24, 2003 (TW) ..... 92103848 A

(51) Int. Cl.
*G09G 3/36* (2006.01)

(52) U.S. Cl. ..... 345/92; 345/87; 345/94; 345/103; 345/208; 345/691

(58) Field of Classification Search ..... 345/87–105, 345/204–215, 690–699
See application file for complete search history.

(56) References Cited

U.S. PATENT DOCUMENTS 5,526,012 A * 6/1996 Shibahara ..... 345/92
6,310,372 B1 * 10/2001 Katayama et al. ..... 257/291
6,791,523 B2 * 9/2004 Fujita et al. ..... 345/92
7,321,355 B2 * 1/2008 Lee et al. ..... 345/103

* cited by examiner

*Primary Examiner*—Vijay Shankar
(74) *Attorney, Agent, or Firm*—Seyfarth Shaw LLP

(57) ABSTRACT

A driving circuit and a driving method can drive an LCD panel to display imagines. Storages capacitors of pixels connected with each scanning line are connected with an AC signal source. The AC signal source can vary the potential of its signal in harmony with the polarity inversion of a pixel during a vertical scanning period. Due to a capacitively coupled effect, a coupled voltage induced by the variation in the potential of the signal changes the potential of a pixel electrode so as to speed up the alternation in the electrical field of an LC capacitor.

15 Claims, 7 Drawing Sheets

DRIVING CIRCUIT AND METHOD FOR LIQUID CRYSTAL DISPLAY PANEL

BACKGROUND OF THE INVENTION

1. Field of the Invention

The present invention relates to a driving circuit and a driving method for a liquid crystal display (LCD) panel, and more particularly to a driving circuit and a driving method for an active matrix LCD panel capable of shortening response time.

2. Description of the Related Art

The LCD technology has progressed in the manufacture of high contrast and wide view angle flat displays. However, for the dynamic image that displays a continuous movement, the image quality deteriorates due to blur images caused by a response delay. Recently, there have been many relative driving methods to improve the response time of LCD panels, and the capacitively coupled driving (CCD) method provided by Matsushita Electric Industrial Co., Ltd. is one superior solution which has a fast response to charge the potentials of pixel electrodes. Therefore, the electrical field of an LC capacitor changes very fast after a gradation voltage being written therein.

FIG. 1 is an equivalent circuit diagram of a conventional LCD panel. The LCD panel 10 has a plurality of pixels 13 formed by a plurality of data lines 121-12*n* crossing a plurality of scanning lines 111-11*m*. Each of the pixels 13 includes a thin film transistor (TFT) 131 and an LC capacitor 133 that controls the rotation directions of LC molecules. A TFT 131 can be turned on and off by the scanning signal $\Phi_1$ applied to the scanning line 112. The two terminals of the LC capacitor 133 are separately connected with a pixel electrode 134 and a common electrode 135. Furthermore, a storage capacitor 132 included in the pixel 13 also has two terminals respectively connected with the pixel electrode 134 and the scanning line 111. The existence of the storage capacitor 132 can keep the potential of the pixel electrode 134 in an adequate variable range, and reduces current leakage resulted from the properties of LC materials and undesired parasitic capacitors.

FIG. 2 is a waveform diagram of the potentials of scanning signals and a pixel electrode applied by a conventional CCD method. During a vertical scanning period (or a frame time), scan signals $\Phi_1, \Phi_2, \ldots, \Phi_m$ are respectively applied to scanning lines 111-11*m* in sequence, and each scanning signal can sequentially turn on the TFTs 131 connected with the corresponding scanning line so as to allow a corresponding data signal to be written into the LC capacitor 133. The CCD method enables two adjacent scanning lines to be respectively input signals $\Phi_{k-1}$ and $\Phi_k$ of four potential levels V1-V4. Because the storage capacitor 132 is connected with a previous scanning line, a coupled voltage Vcc is applied to the pixel electrode 134 from the variation of the potentials of the signal $\Phi_{k-1}$ so that $V_p$=Vs+Vcc, wherein Vp represents the current potential of the pixel electrode 134, Vs represents the gradation voltage supplied by the data line and Vcc represents the coupled voltage applied to the pixel electrode 134.

FIGS. 3(*a*)-4(*b*) show waveform diagrams of overshooting or undershooting variations in the potentials of a pixel electrode 134. Due to these abrupt changes, the LC capacitor 133 can rapidly adjust its electrical field to a predefined one. As shown in FIGS. 3(*a*)-3(*b*), the potentials of the pixel electrode 134 vary when the electrical field of the LC capacitor 133 changes from low to high. Referring to FIG. 3(*a*), the potential of the pixel electrode abruptly rises due to a coupled voltage when the pixel is defined from a negative polarity to a positive polarity. The rise of the potential Vcc(+) is the magnitude of the coupled voltage and is regarded as an overshooting phenomenon. Further referring to FIG. 3(*b*), the potential of the abruptly falls due to a coupled voltage when the pixel is defined from a positive polarity to a negative polarity. The fall of the potential Vcc(−) is the magnitude of the coupled voltage and is regarded as an overshooting phenomenon.

Furthermore, as shown in FIGS. 4(*a*)-4(*b*), the potentials of the pixel electrode 134 vary when the electrical field of the LC capacitor 133 changes from high to low. Referring to FIG. 4(*a*), the potential of the abruptly rises due to a coupled voltage when the pixel is defined from a negative polarity to a positive polarity. The rise of the potential Vcc(+) is the magnitude of the coupled voltage and is regarded as an undershooting phenomenon. Further referring to FIG. 4(*b*), the potential of the abruptly falls due to a coupled voltage when the pixel is defined from a positive polarity to a negative polarity. The fall of the potential Vcc(−) is the magnitude of the coupled voltage and is regarded as an undershooting phenomenon.

The CCD method, a prior art technology/technique, is also called a four potential levels driving (including four potential levels V1-V4), wherein V1 and V3 can respectively turn on and off the TFT 131, and V2 and V4 are driving potentials to induce coupled voltages Vcc. The properties of the TFT 131 determine the magnitude of V1 and V3. In addition, the magnitude of V2 and V4 limited by V1 and V3 has a narrow adjustable range, so that the magnitude of the coupled voltage is under a specific value. On the other hand, specific driving devices are needed for generating the scanning signal consisting of four potential levels. Therefore, it is difficult to obtain these driving devices for a practical application. Furthermore, the RC delay on a scanning line becomes worse due to the connection between the storage capacitors 132 and the scanning line.

Because the conventional driving circuit of an LCD panel is unable to independently control the magnitude of the coupled voltage, data driving devices still need to output the data signals with wide potential ranges so that it is hard to meet the requirement of the LCD market.

SUMMARY OF THE INVENTION

An objective of the present invention is to provide a driving circuit and a driving method for an LCD panel whose storages capacitors of pixels connected with each scanning line are connected with an AC signal source, so coupled voltages applied to pixel electrodes can be modulated line-byline or cluster-by-cluster. In comparison with the prior art that modulates the potential of a whole common electrode, the present invention substantially reduces power consumption and lowers the modulation frequency the prior art requires.

The second objective of the present invention is to provide an easy applied method of capacitively coupled driving. It displays superior dynamic images to the four potential levels driving without employing specially scanning driving devices.

The third objective of the present invention is to provide a driving circuit and a driving method for an LCD panel. It is compatible for various types of LCD panels including IPS (In-Plane Switching) type and MVA (Multi-Domain Vertical Alignment) type.

The fourth objective of the present invention is to provide a driving circuit and a driving method for independently controlling the occurrence of coupled voltages. The magnitude of the coupled voltage can be larger than the magnitude of that resulted from the conventional CCD method, so that the range of voltages output by the data-driving device can be reduced.

In order to achieve the objective, the present invention discloses a driving circuit and a driving method for an LCD panel. Storages capacitors of pixels connected with each scanning line are connected with an AC signal source. The AC signal source can vary the potential of its signal in harmony with the polarity inversion of a pixel during a vertical scanning period. Due to a capacitively coupled effect, a coupled voltage induced by the variation in the potential of the signal changes the potential of a pixel electrode so as to speed up the alternation in the electrical field of an LC capacitor. Therefore, the LCD panel is suitable for displaying a fast continuous movement and reduces power consumption.

BRIEF DESCRIPTION OF THE DRAWINGS

The invention will be described according to the appended drawings in which.

PREFERRED EMBODIMENT OF THE PRESENT INVENTION

Figure 1:
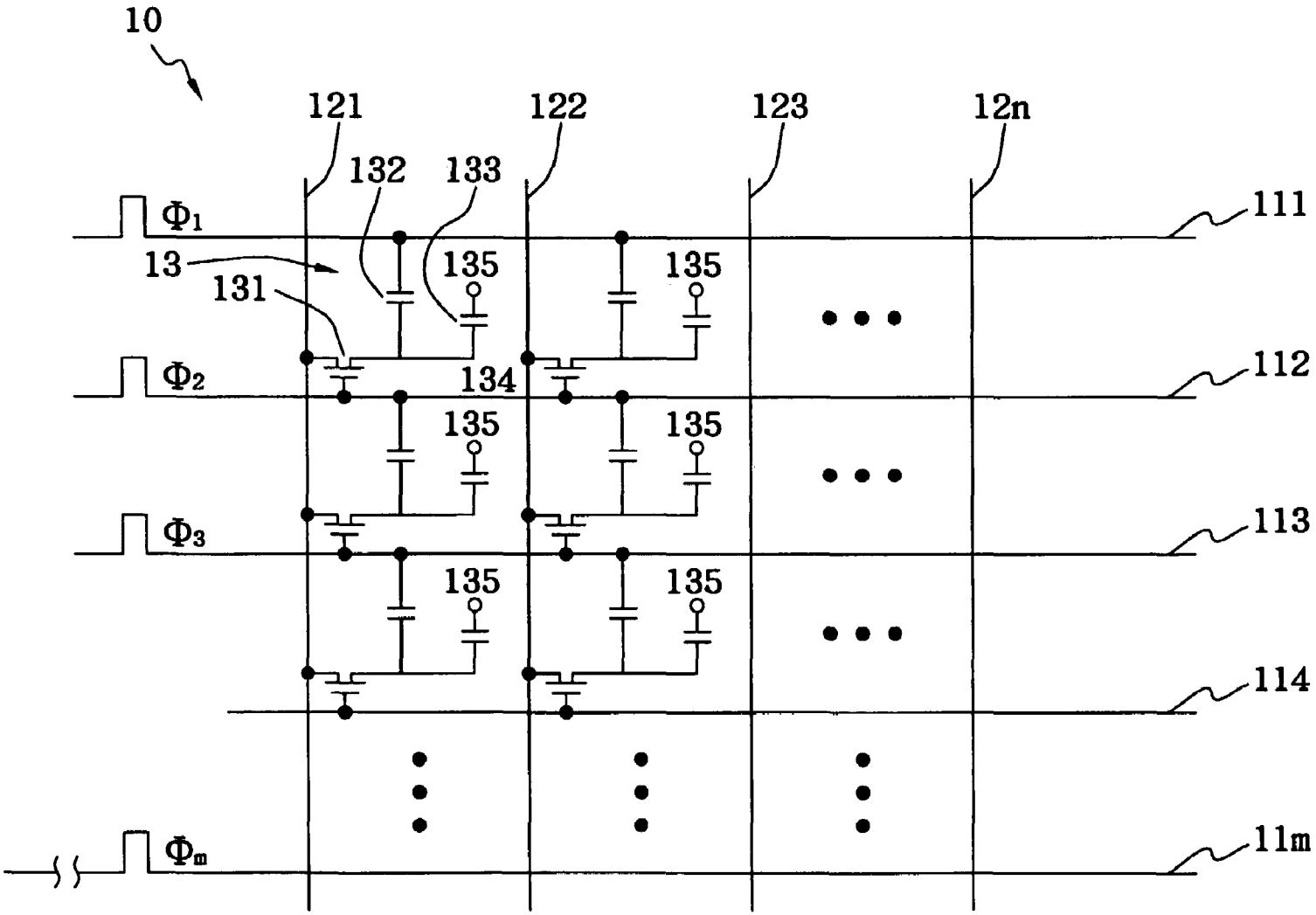
FIG. 1 (Background Art)
FIG. 1 is a circuit diagram in accordance with the LCD panel of a prior art reference.
Figure 2:
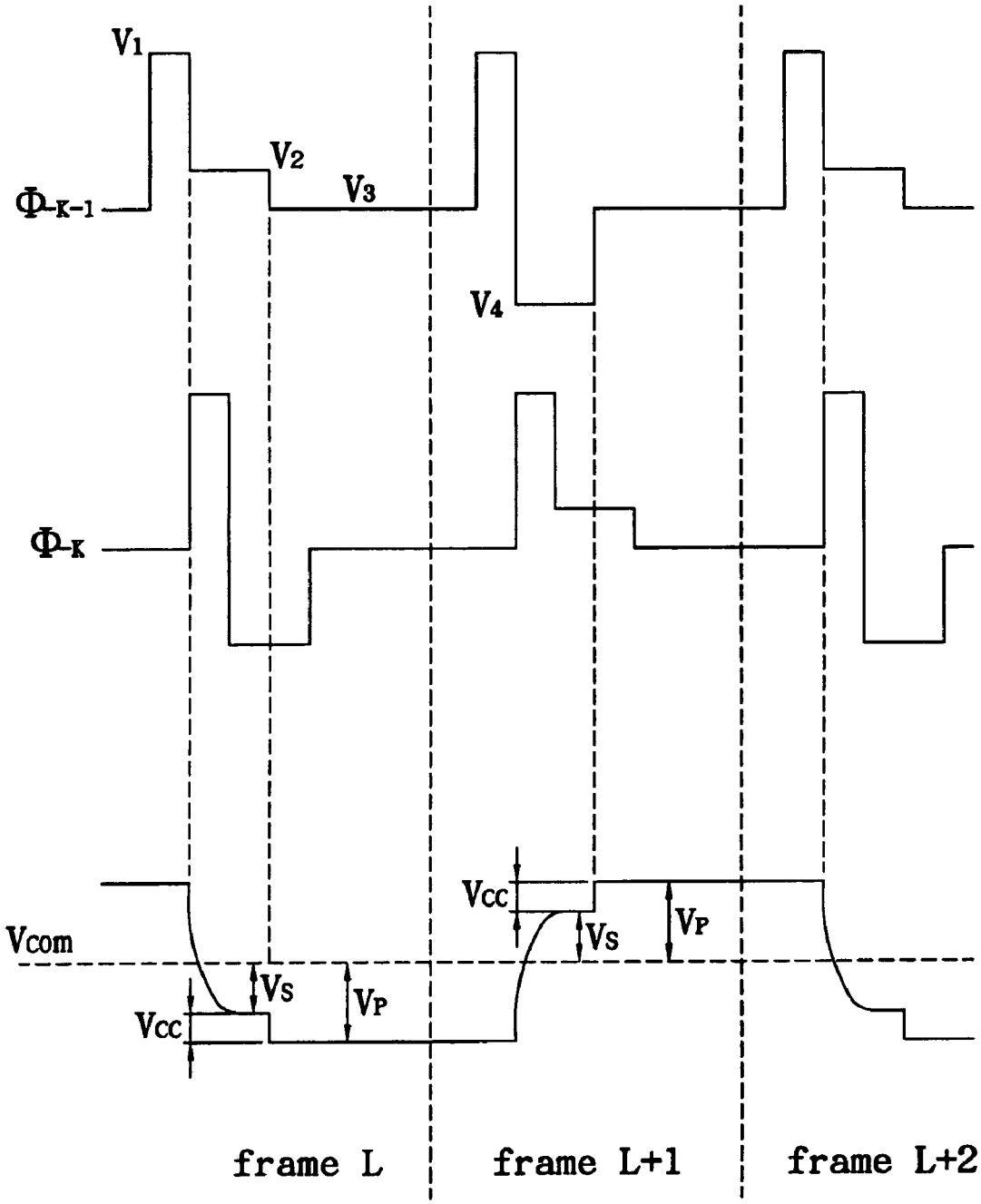
FIG. 2 (Background Art)
FIG. 2 is a waveform diagram of the scanning signals and the potential of a pixel electrode driven by a conventional capacitively coupled driving method.
Figure 3A:
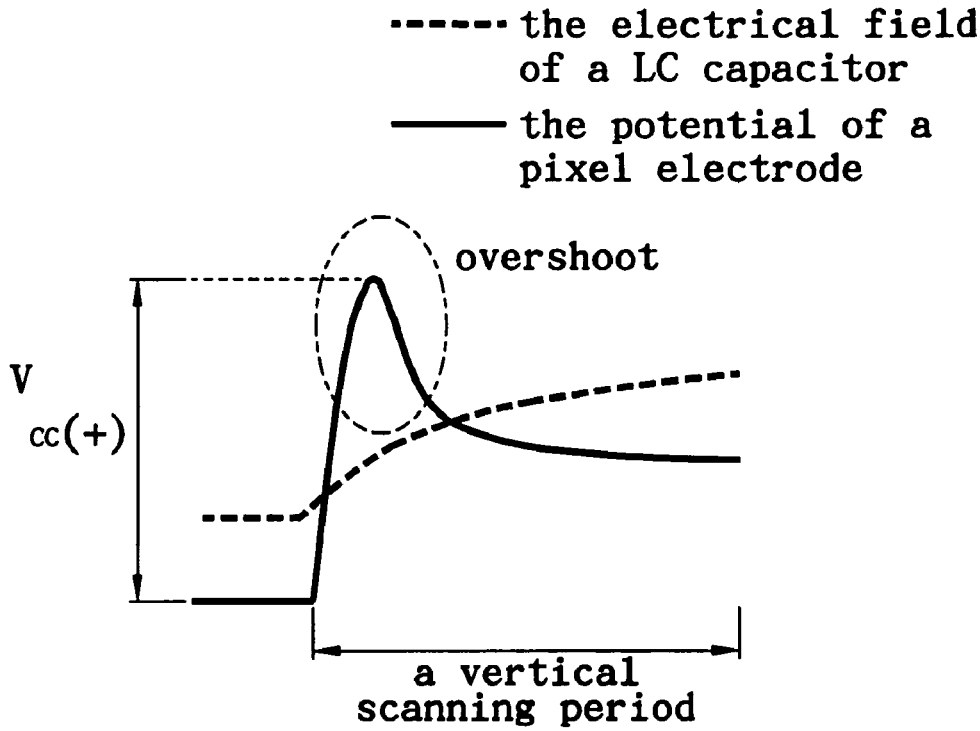
FIG. 3(a) (Background Art)
FIGS. 3(*a*)-3(*b*) are waveform diagrams of the potentials of a pixel electrode taken when the electrical field of an LC capacitor changes from low to high.
Figure 3B:
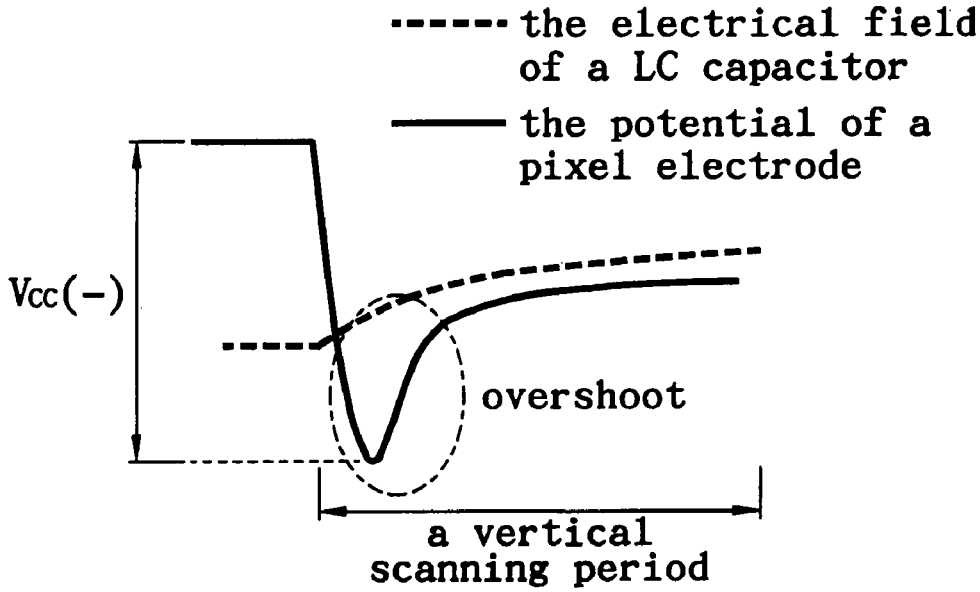
FIG. 3(b) (Background Art)
Figure 4A:
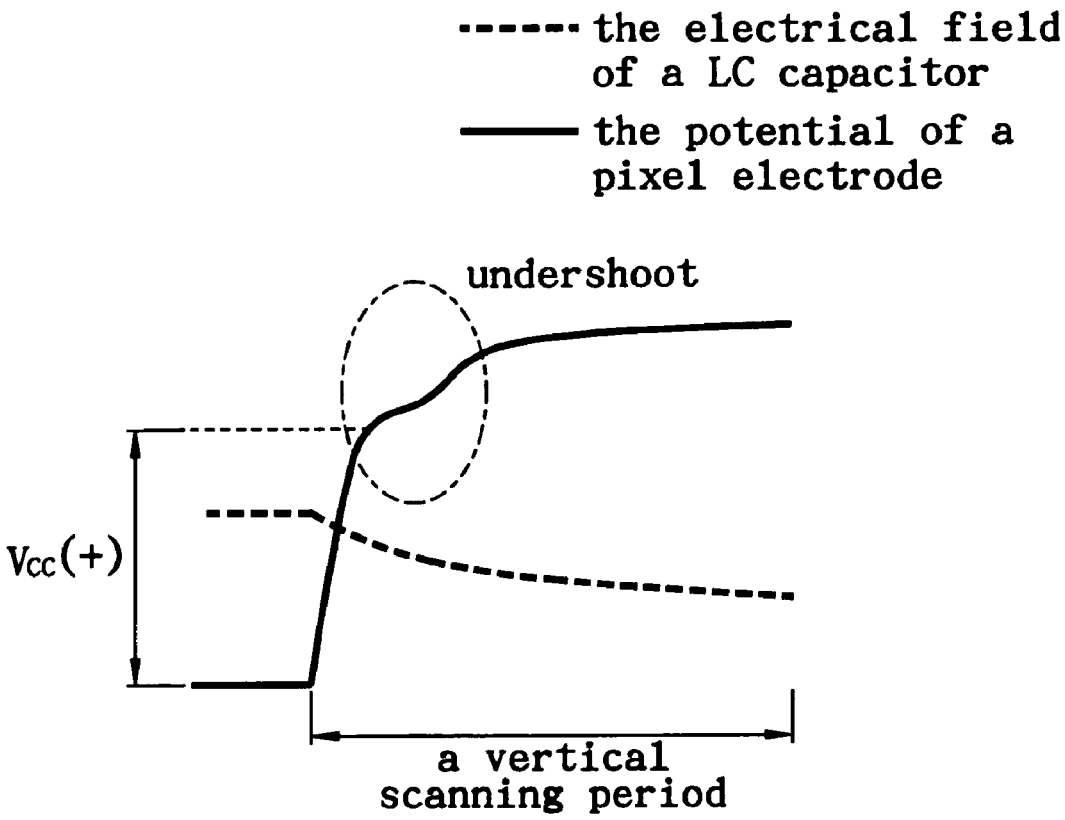
FIG. 4(a) (Background Art)
FIGS. 4(*a*)-4(*b*) are waveform diagrams of the potentials of a pixel electrode taken when the electrical field of an LC capacitor changes from high to low.
Figure 4B:
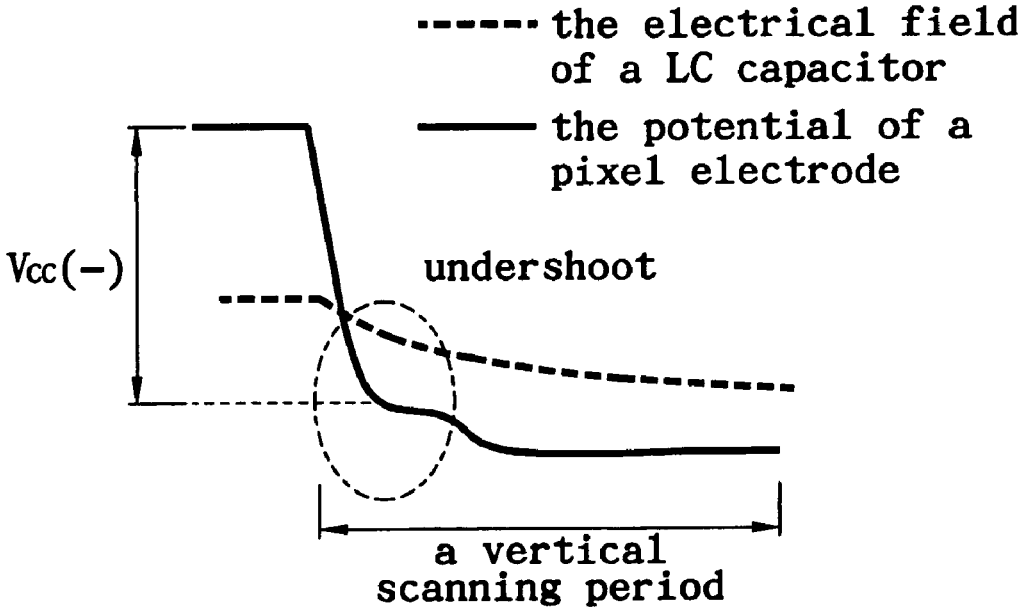
FIG. 4(b) (Background Art)
Figure 5:
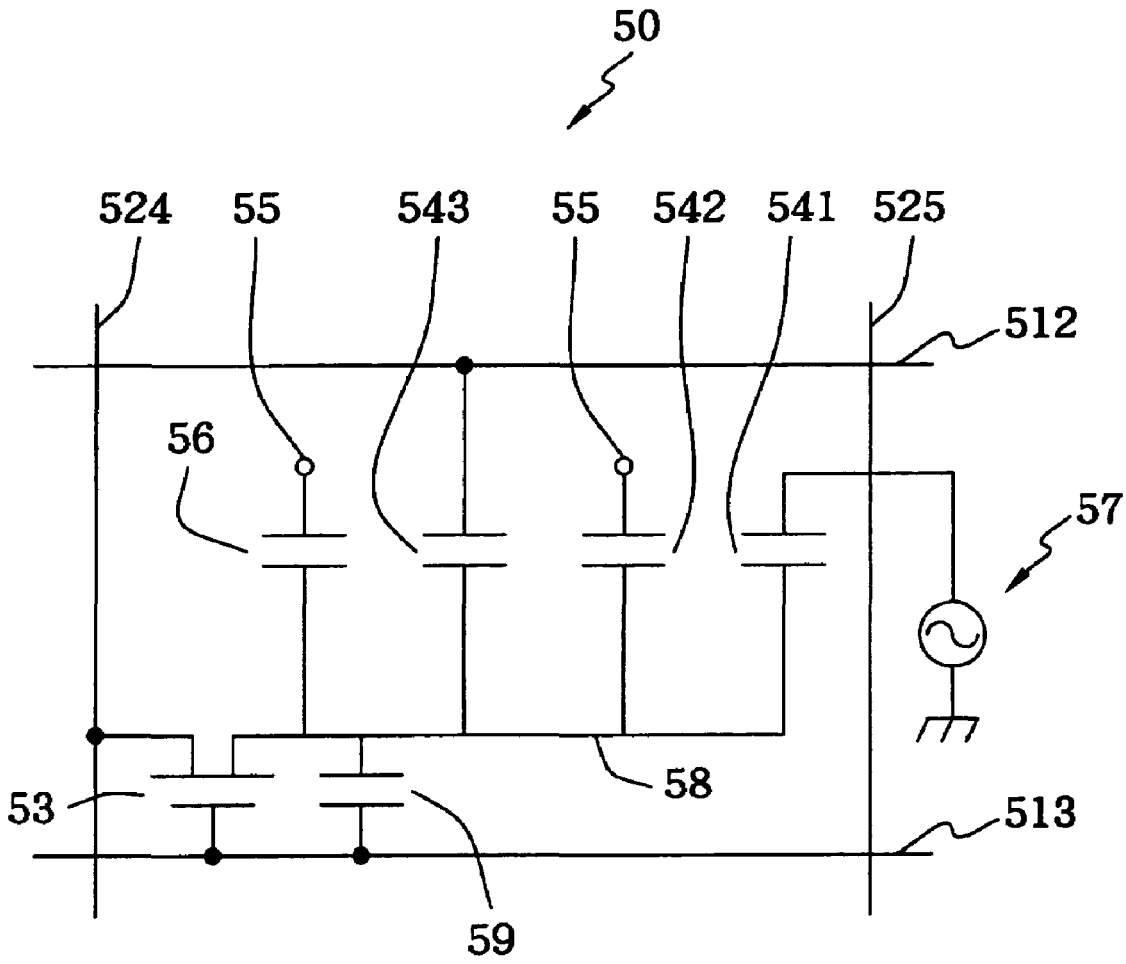
FIG. 5 is an equivalent circuit diagram of a pixel in accordance with the LCD panel of the present invention.

FIG. 5 is an equivalent circuit diagram of a pixel in accordance with the LCD panel of the present invention. The pixel 50 can be regarded as any one of the pixels of an LCD panel, that is, all pixels have the same circuit layout. Two parallel scanning lines 512 and 513 are respectively perpendicular to two parallel data lines 524 and 525, wherein an enclosed area is the region of the pixel 50. The gate terminal and source terminal of a thin film transistor (TFT) 53 are respectively connected with the scanning line 513 and the data line 524. After the TFT 53 is selected to be turned on by a scanning signal applied to the scanning line 513, a data signal is written into an LC capacitor 56 whose another terminal is connected with a common electrode 55. Furthermore, the pixel 50 comprises a first storage capacitor 541, a second storage capacitor 542 and a third storage capacitor 543 capable of stabilizing the voltage applied to the LC capacitor 56, so that the drop of the voltage caused by a feed-through effect can be reduced. The second storage capacitor 542 and third storage capacitor 543 can be excluded in some cases, that is, they are optional devices for the present invention.

Another terminal of the second storage capacitor 542 is connected with common electrode 55; another terminal of the third storage capacitor 543 is connected with a previous scanning line 512; and another terminal of the first storage capacitor 541 is connected with a modulation signal source 57. The potential of the pixel electrode 58 can be modulated by a modulation signal from the modulation signal source 57 and a capacitively coupled effect, so that the electrical field of the LC capacitor 56 is fast driven to vary therein. The first storage capacitors 541 of pixels connected with a same scanning line 513 can be connected with a signal source 57. Therefore, the potentials of the pixel electrodes 59 are modulated line-by-line and pixel-by-pixel in accordance with the scanning sequence of scanning lines. Due to the limitation of the manufacturing process, a parasitic capacitor 59 certainly exists between the gate terminal and drain terminal of the TFT 53, and results in the feedthrough effect.

Figure 6A:
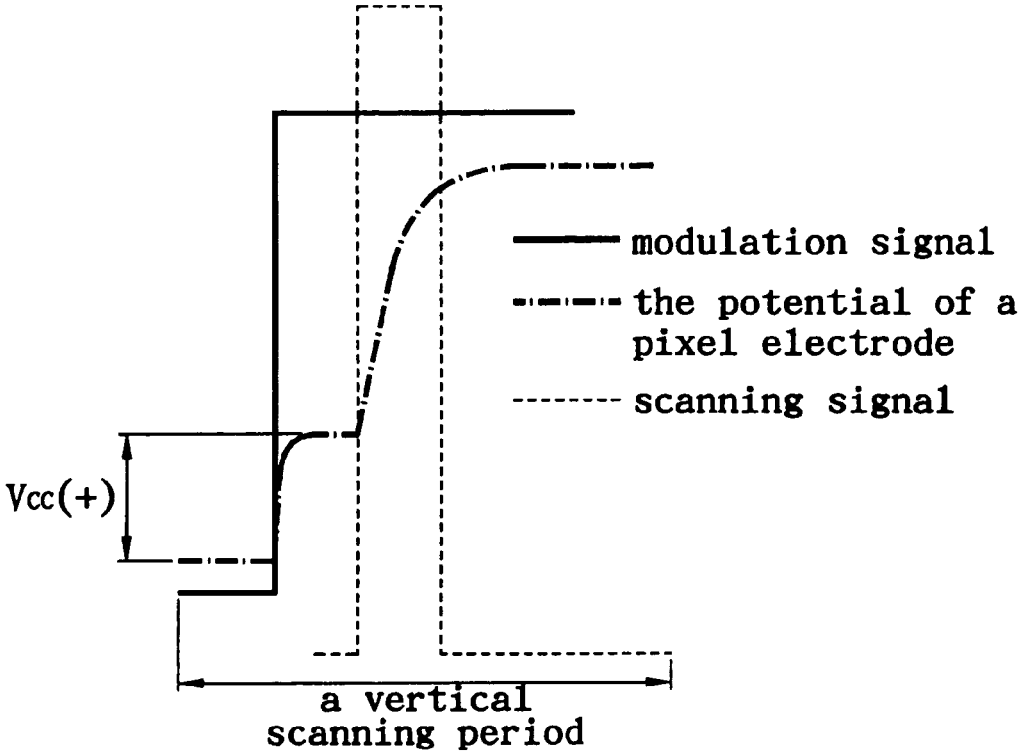
FIGS. 6(*a*)-6(*b*) are waveform diagrams of coupled voltages induced by modulation signals in accordance with the first embodiment of the present invention.
Figure 6B:
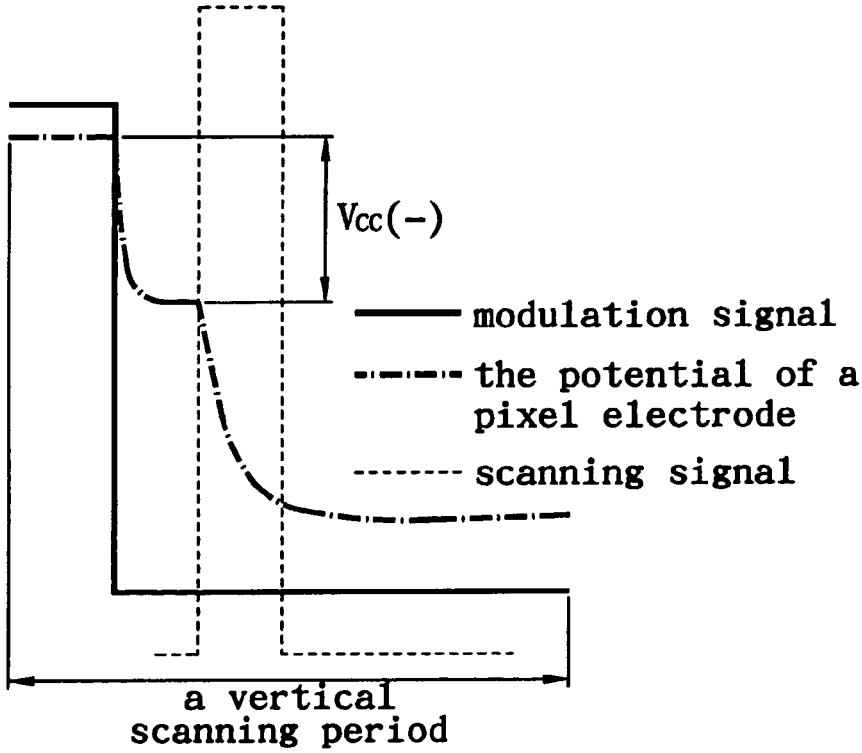

FIGS. 6(*a*)-6(*b*) are waveform diagrams of coupled voltages induced by modulation signals in accordance with the first embodiment of the present invention. The modulation signal is applied to a pixel prior to that a scanning signal turns on the TFT. FIG. 6(*a*) represents that the polarity of the pixel changes from negative to positive. Because a square pulse rising from a lower level to a higher level, acting as the modulation signal, is written into the first storage capacitor 541, the potential of the pixel electrode 58 rises from an initial level to a first level in advance by a capacitively coupled effect. The rise Vcc (+) of the potential is a capacitively coupled voltage. After that, the TFT 53 is turned on by a scanning signal. A data signal from data line 524 is written into the pixel electrode 58 to change the potential of the pixel electrode 58 from the first level to the second level, and the variation of the potential of the pixel electrode 58 is equal to the potential of the data signal. FIG. 6(*b*) represents that the polarity of the pixel changes from positive to negative. Similarly, a square pulse, falling from a higher level to a lower level, acting as the modulation signal is written into the first storage capacitor 541. Therefore, the potential of the pixel electrode 58 abruptly falls from a initial level to a first level in advance of the change of the polarity by the capacitively coupled effect, and the fall Vcc (−) of the potential is a capacitively coupled voltage. After that, the TFT 53 is turned on by a scanning signal. A data signal from data line 524 is written into the pixel electrode 58 to change the potential of the pixel electrode 58 from the first level to the second level, and the variation of the potential of the pixel electrode is equal to the potential of the data signal. As shown FIG. 6(*a*), in order to have a better image quality in the preferred embodiment of the present invention, the higher level of the potential of the modulation signal is higher than the second level of the potential of the pixel electrode 58 when the polarity of the pixel changes from negative to positive. On the other hand, as shown in FIG. 6(*b*), the lower level of the potential of the modulation signal is lower than the second level of the potential of the pixel electrode 58 when the polarity of the pixel changes from positive to negative.

Figure 7A:
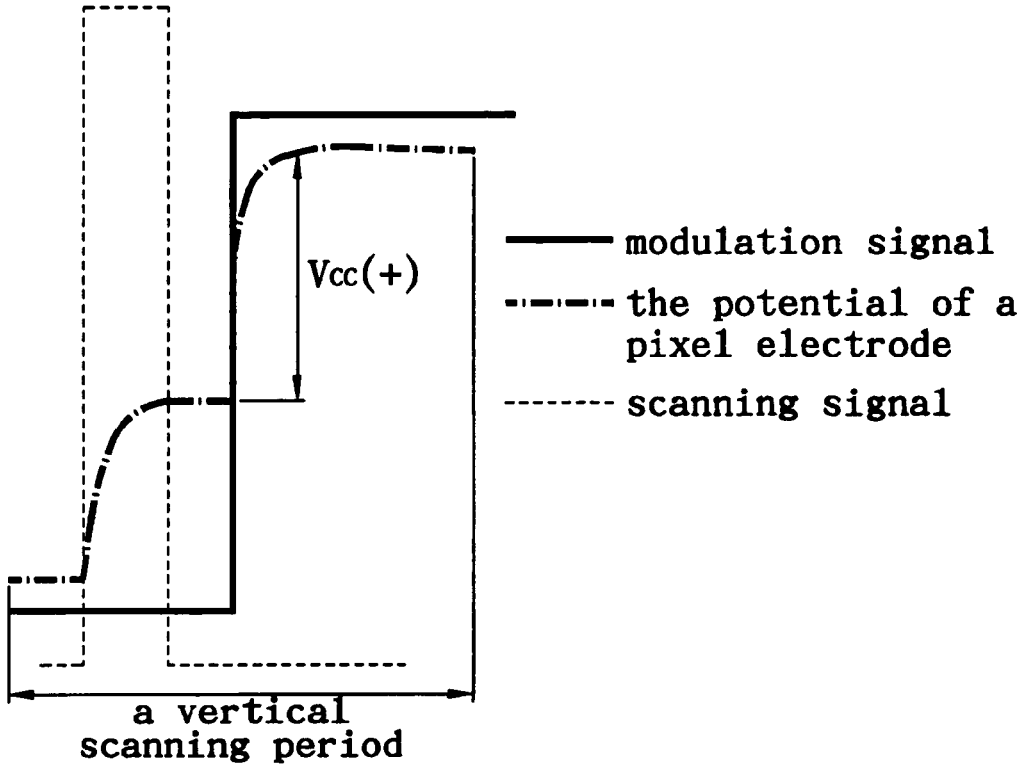
FIGS. 7(*a*)-7(*b*) are waveform diagrams of coupled voltages induced by modulation signals in accordance with the second embodiment of the present invention.
Figure 7B:
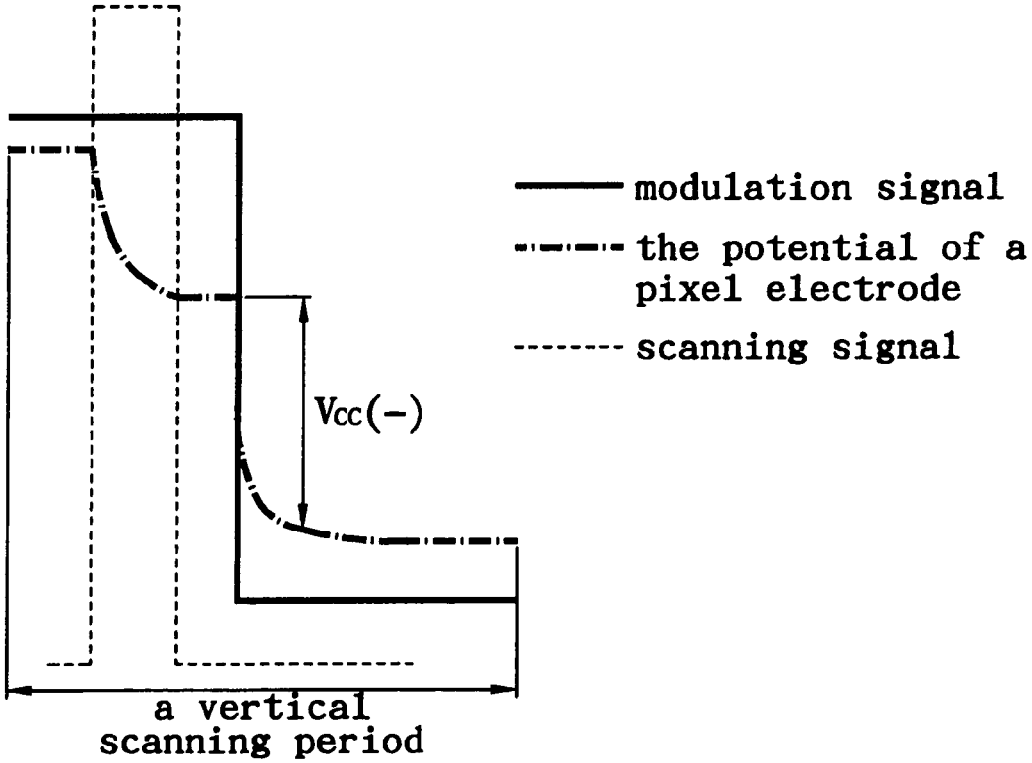

FIGS. 7(*a*)-7(*b*) are waveform diagrams of coupled voltages induced by modulation signals in accordance with the second embodiment of the present invention. The modulation signal is applied to a pixel posterior to that a scanning signal turns off the TFT. FIG. 7(*a*) represents that the polarity of the pixel changes from negative to positive. When turning on the TFT 53 by a scanning signal, the potential of the pixel electrode 58 rises from an initial level to a first level because a data signal from the data line 524 is written into the pixel electrode 58. The difference between the initial level and the first level of the pixel electrode 58 potential is equal to the potential of the data signal. After that, a square pulse rising from a lower level to a higher level, acting as the modulation signal, is written into the first storage capacitor 541. The potential of the pixel electrode 58 further rises from the first level to the second level by a capacitively coupled effect. The rise Vcc (+) of the potential is a capacitively coupled voltage. FIG. 7(*b*) represents that the polarity of the pixel changes from positive to negative. Similarly, when turning on the TFT 53 by a scanning signal, the potential of the pixel electrode 58 falls from an initial level to a first level because a data signal from the data line 524 is written into the pixel electrode 58. The difference between the initial level and the first level of the potential of the pixel electrode 58 is equal to the potential of the data signal. After that, a square pulse falling from a higher level to a lower level, acting as the modulation signal, is written into the first storage capacitor 541. The potential of the pixel electrode 58 further falls from the first level to the second level by a capacitively coupled effect. The fall Vcc (−) of the potential is a capacitively coupled voltage. As shown FIG. 7(*a*), in order to have a better image quality in the preferred embodiment of the present invention, the higher level of the potential of the modulation signal is higher than the second level of the potential of the pixel electrode when the polarity of the pixel changes from negative to positive. On the other hand, as shown in FIG. 7(*b*), the lower level of the potential of the modulation signal is lower than the second level of the potential of the pixel electrode when the polarity of the pixel changes from positive to negative.

Since the present invention discloses that a modulation signal is written into the first storage capacitor from an isolated modulation signal source and then a coupled voltage is induced on the pixel electrode, it has many degrees of freedom to design the waveform shape of the modulation signal. In comparison with the prior art disclosing a scanning signal with four potential levels, this method can have a coupled voltage with higher magnitude induced by the isolated modulation signal source. Therefore, the maximum amplitude of the data signal can be reduced and the power consumption of a data-driving device can be saved.

The above-described embodiments of the present invention are intended to be illustrative only. Numerous alternative embodiments may be devised by persons skilled in the art without departing from the scope of the following claims.

What is claimed is:

1. A driving method for a liquid crystal display panel that includes a plurality of matrix-arranged pixels positioned on intersections of a plurality of scanning lines and a plurality of data lines, each of the pixels having (a) a thin film transistor whose gate electrode, source electrode and drain electrode are separately connected to the scanning line, the data line and a pixel electrode and (b) a first storage capacitor whose one terminal electrically connected to the pixel electrode and another terminal electrically connected to a modulation signal source electrically independent from the scanning lines and a common electrode, comprising the steps of:

starting a scanning period for the scanning line;

writing a modulation signal provided by the modulation signal source into the first storage capacitor;

inducing a coupled voltage to change the potential of the pixel electrode from an initial level to a first level through the modulation signal applied to the first storage capacitor, wherein the variation of the potential of the pixel electrode is substantially equal to the coupled voltage; and writing a data signal from the data line into the pixel electrode to change the potential of the pixel electrode from the first level to a second level, wherein the variation of the potential of the pixel electrode is substantially equal to the potential of the data signal.

2. The driving method for a liquid crystal display panel of claim 1, wherein THE potential of the modulation signal changes from a lower level to a higher level as a square pulse, and meantime the polarity of the pixel changes from negative to positive during the scanning period.

3. The driving method for a liquid crystal display panel of claim 2, wherein the higher level of the potential of the modulation signal is higher than the second level of the potential of the pixel electrode.

4. The driving method for a liquid crystal display panel of claim 1, wherein the higher level of the potential of the modulation signal changes from a higher level to a lower level as a square pulse, and meantime the polarity of the pixel changes from positive to negative during the scanning period.

5. The driving method for a liquid crystal display panel of claim 4, wherein the lower level of the potential of the modulation signal is lower than the second level of the potential of the pixel electrode.

6. The driving method for a liquid crystal display panel of claim 1, wherein the pixel further comprises a second storage capacitor whose two terminals are separately connected to the pixel electrode and the common electrode.

7. The driving method for a liquid crystal display panel of claim 1, wherein the pixel further comprises a third storage capacitor whose two terminals are separately connected to the pixel electrode and the scanning line adjacent to the pixel, and the scanning line adjacent to the pixel is electrically isolated from the gate terminal of the thin film transistor of the pixel.

8. The driving circuit for a liquid crystal display panel of claim 1, wherein the scanning lines transmit two-level scanning signals.

9. The driving circuit for a liquid crystal display panel of claim 1, wherein the modulation signal is applied to the first storage capacitor before the thin film transistor is turned on.

10. The driving circuit for a liquid crystal display panel of claim 1, wherein the modulation signal is applied to the first storage capacitor after the thin film transistor is turned on.

11. A driving circuit for a liquid crystal display panel, comprising:

a plurality of data lines;

a plurality of scanning lines;

a common electrode; and a plurality of pixels positioned on intersections of the scanning lines and the data lines, each of the plurality of pixels including:

a thin film transistor whose gate electrode, source electrode and drain electrode are separately connected to the scanning line, the data line and a pixel electrode;

a liquid crystal capacitor whose two terminals are separately connected to the pixel electrode and the common electrode;

a first storage capacitor having one terminal electrically connected to the pixel electrode; and a modulation signal source electrically connected to another terminal of the first storage capacitor, electrically independent from the scanning lines and the common electrode, and providing modulation signals to the first storage capacitor so as to generate corresponding coupled voltages.

12. The driving circuit for a liquid crystal display panel of claim 11, wherein each of the plurality of pixels further comprises a second storage capacitor whose two terminals are separately connected to the pixel electrode and the common electrode.

13. The driving circuit for a liquid crystal display panel of claim 11, wherein each of the plurality of pixels further comprises a third storage capacitor whose two terminals are separately connected to the pixel electrode and the scanning line adjacent to the pixel, and the scanning line adjacent to the pixel is electrically isolated from the gate terminal of the thin film transistor of the pixel.

14. The driving circuit for a liquid crystal display panel of claim 11, wherein the modulation signal source generates a square pulse as the modulation signal.

15. The driving circuit for a liquid crystal display panel of claim 11, wherein the scanning lines transmit two-level scanning signals.

* * * * *